United States Patent [19]

Sato

[11] Patent Number: 4,873,798

[45] Date of Patent: Oct. 17, 1989

[54] APPARATUS FOR SUPPRESSING VIBRATION OF STRUCTURE

[75] Inventor: Takanori Sato, Tokyo, Japan

[73] Assignee: Shimizu Construction Co., Ltd., Tokyo, Japan

[21] Appl. No.: 271,104

[22] Filed: Nov. 14, 1988

[30] Foreign Application Priority Data

Nov. 17, 1987 [JP] Japan ..... 62-290236

[51] Int. Cl.[4] ..... F16F 7/10; F23J 13/00

[52] U.S. Cl. ..... 52/167 DF; 52/168

[58] Field of Search ..... 52/167, 168

[56] References Cited

U.S. PATENT DOCUMENTS 4,226,554 10/1980 Vandiver ..... 405/195
4,301,560 11/1981 Fraige ..... 5/450
4,481,248 11/1984 Fraige ..... 428/283
4,783,937 11/1988 Sato .

FOREIGN PATENT DOCUMENTS 999421 7/1965 United Kingdom .
1322807 7/1973 United Kingdom ..... 52/167

*Primary Examiner*—Henry S. Raduazo
*Attorney, Agent, or Firm*—Hoffman & Baron

[57] ABSTRACT

An apparatus for suppressing vibration of a structure. The apparatus includes a tank adapted to be mounted in the structure and a chamber defining mechanism, arranged within the tank, for defining a plurality of annular chambers, concentric about a vertical axis of the tank, to receive a liquid for suppressing vibration of the structure. The chambers are each adapted to contain such an amount of the liquid that the liquid is equal in natural period to the structure.

7 Claims, 3 Drawing Sheets

APPARATUS FOR SUPPRESSING VIBRATION OF STRUCTURE

BACKGROUND OF THE INVENTION

The present invention relates to an apparatus for suppressing vibration, caused by wind, earthquake or the like, of a structure, such as architectural and civil structures.

The inventor proposed, as a sole or a joint inventor, various types of the vibration suppressing apparatus in copending U.S. patent application Ser. No. 07/042,365 filed on Apr. 24, 1987 entitled "DEVICE FOR SUPPRESSING VIBRATION OF STRUCTURE", U.S. patent application Ser. No. 179,438 filed on Apr. 8, 1988 entitled "METHOD FOR RESTRAINING VIBRATION OF A BUILDING AND STRUCTURE THEREFOR", U.S. patent application Ser. No. 07/186,394 filed on Apr. 26, 1988 entitled "METHOD FOR RESTRAINING VIBRATION OF A FLOOR AND APPARATUS THEREFOR", U.S. patent application Ser. No. 07/186,613 filed on Apr. 27, 1988 entitled "METHOD FOR RESTRAINING RESPONSE OF A STRUCTURE TO OUTSIDE DISTURBANCES AND APPARATUS THEREFOR", U.S. patent application Ser. No. 07/191,278 filed on May 6, 1988 entitled "METHOD FOR EFFECTIVELY RESTRAINING RESPONSE OF A STRUCTURE TO OUTSIDE DISTURBANCES AND APPARATUS THEREFOR", and U.S. patent application Ser. No. 07/196,325 filed on May 20, 1988 eniitled "DEVICE FOR SUPPRESSING VIBRATION OF STRUCTURE". The disclosure of each of these U.S. applications is incorporated herein by reference.

With recent developments of high strength materials and with rapid progress in both construction engineering and computer structure analysis, high-rise structures have become much more lightweight and flexible than conventional ones. Such lightweight and flexible high-rise structures have a tendency that the natural frequency and vibration damping factor thereof become smaller, and hence there is a possibility that various kinds of vibration unexpectedly occur with a large amplitude due to external forces caused by earthquake and wind. Thus, such vibration of these structures can give uneasiness to occupants therein and, further, may provide stress beyond an allowable limit to the structures.

In U.S. Pat. No. 4,226,554, issued on Oct. 7, 1980, Vandiver et al teach an apparatus for absorbing dynamic forces, caused by wind, wave or seismic excitation, on a structure, in which apparatus a liquid, contained in a tank mounted on a structure, reduces a dynamic response of the structure when the latter is vibrated. This type of vibration suppressing device may be used for solving the above mentioned problems. However, it has a drawback in that it takes a considerable space in a structure and hence has a rather low space efficiency.

Accordingly, it is an object of the present invention to provide an apparatus for suppressing vibration of a structure, which apparatus is compact in construction and is hence excellent in space efficiency as compared to the prior art vibration suppressing device. Thus, the vibration suppressing apparatus according to the present invention may be installed in a desired location of a structure.

SUMMARY OF THE INVENTION

In view of this and other objects, the present invention provide an apparatus for suppressing vibration of a structure. The apparatus includes a tank adapted to be mounted in the structure and a chamber defining mechanism, arranged within the tank, for defining a plurality of annular chambers, concentric about a vertical axis of the tank, to receive a liquid for suppressing vibration of the structure. The chambers are each adapted to contain such an amount of the liquid that the liquid is equal in natural period to the structure. With such a construction, the apparatus of the present invention provides a high vibration suppression effect for a given volume of the tank as compared to the apparatus according to the prior art, since in the former, vibration energy of the liquid is dissipated by impingement of opposite circumferential flows thereof as well as impingement upon chamber walls while in the prior art apparatus, significant suppression of vibration is not carried out in the central part of the tank.

In a preferred arrangement, the apparatus is provided with vibration damping means, arranged in at least one of the chambers, for damping vibration of the liquid, contained in the at least one chamber, due to swinging of the structure. The vibration damping means may include a screen member which comprises a frame, mounted to the bottom of the tank, and a screen attached to the frame to extend for baffling the flow of the liquid due to the swinging of the structure, and the screen member may be arranged to direct radially in the tank. The screen member effectively baffles circumferential flows of the liquid due to the swinging of the structure, so that vibration of the vibration suppressing apparatus is damped as well as the vibration of the structure, whereby it is capable of preventing the vibration suppressing apparatus from exciting the structure.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
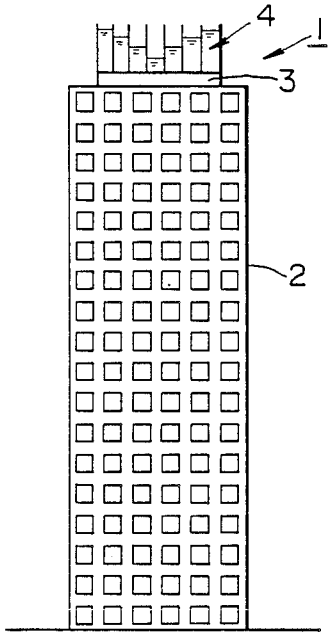
FIG. 1 is a diagrammatic illustration of a building with a vibration suppressing apparatus according to the present invention placed on its rooftop, the vibration suppressing apparatus being illustrated in a vertical section.
Figure 2:
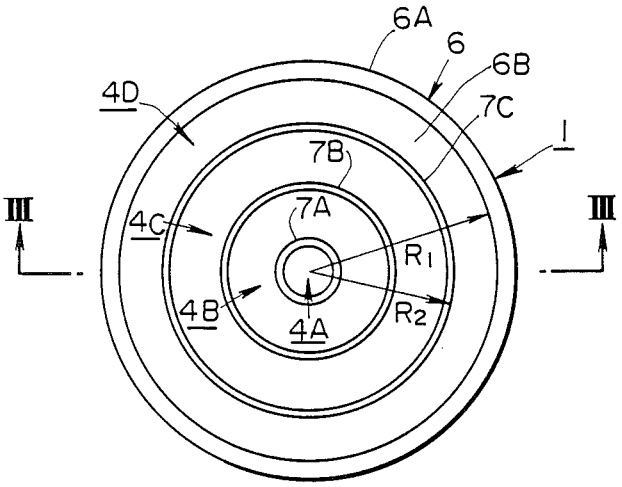
FIG. 2 is an enlarged plan view of the vibration suppressing apparatus in FIG. 1.
Figure 3:
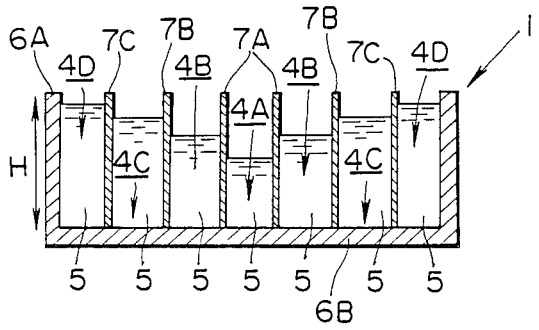
FIG. 3 is a view taken the line III—III in FIG. 2.

Referring now to FIGS. 1 to 3, a vibration suppressing device 1, constructed according to the present invention, is installed on the rooftop of a high-rise building 2 through a conventional vibration insulation base 3 which has a stack construction having resilient plates and steel plates alternatively stacked. It is preferable to mount the vibration suppressing device 1 on the rooftop for suppressing vibrations caused by wind.

The vibration suppressing device 1 includes tank 4 mounted on the vibration insulation base 3. The tank 4 contains a liquid in practice, which may be drinking water, fire water, cooling or heating water, etc. The tank 4 has a hollow cylindrical outer tank 6 with an upper open end 6A. The outer tank 6 is partitioned with three partition members 7A, 7B and 7C, made of cylindrical tubes, which are concentrically arranged about its vertical axis at 4A in FIG. 2 within the outer tank 6 to form separate annular tanks or chambers 4A, 4B, 4C and 4D from the center toward the inner periphery thereof as illustrated in FIG. 2.

The liquid 5 in the tank 4 is adjusted so that it is substantially equal in natural period to the building 2. This adjustment is made by varying the levels H of the liquid 5 according to the specific gravity thereof. The total weight (effective mass) of the liquid 5 within the tank 4 is adjusted to be typically within 1/50 to 1/200, preferably within 1/50 to 1/100 of the total weight (mass) of the building 2. However, this ratio may be about 1/300.

The tank 4 is preferably made of a corrosion resistant material such as synthetic resins and stainless steel. It is preferable to use nonvolatile material, such as oil, as the liquid 5. The material for the tank 4 and the kind of liquid 5 depend on construction conditions.

Figure 4:
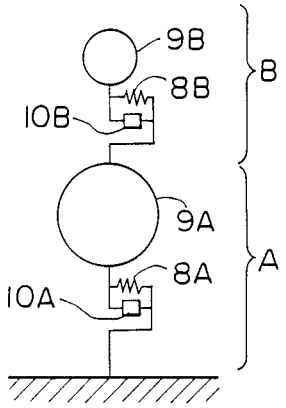
FIG. 4 illustrates a mechanical equivalent system of the building with the vibration suppressing apparatus in FIG. 1.

The vibration system of the building 2 and the vibration suppressing device 1 may be approximated to the mechanical equivalent shown in FIG. 4 since the liquid 5 in separate chambers 4A to 4D vibrates together as if it were a mass. This is because the liquid 5 in each chamber is equal in natural period to the building 2. The vibration equivalent is composed of a first vibration system A, which represents the building 2, and a second vibration system B which is a vibration model of the liquid 5 in the tank 4, the second vibration system connected to the first vibration system in series. The first vibration system A includes a first body 9A of mass Mo, a first spring 8A, which has a spring constant Ko and supports the first body 9A, and a first dashpot 10A having a damping factor ho and added in parallel with the first spring 8A. The second vibration system B has a second body 9B with mass M1, a second spring 8B, which has a spring constant K1 and supports the second body 9B, and a second dashpot 10B having a damping factor h1 and added in parallel with the second spring 9B. When the vibration system A is forced to vibrate by an outer force exerted to the body 9A, the vibration system B begins to vibrate with a phase shifted $\frac{1}{4}$ of the vibration period of the first vibration system A. The vibration of the first vibration system A may be suppressed by making both the vibration system A and B equal in natural period. The natural period of each of the vibration systems A and B is generally given by the equation:

$$Ti = 2\pi\sqrt{\frac{Mi}{Ki}} \tag{1}$$

where Mi is the mass of the vibration system i and Ki is the spring constant of the system i. Since the natural period To of the building 2 is generally defined by both its mass Mo and spring constant Ko, the natural period T1 of the liquid 5 may be made equal to the period To by appropriately selecting the size and volume of the tank 4 and the amount of the liquid 5 contained in it.

According to the velocity potential theory, the natural vibration period T1 of a liquid 5, which vibrates in each annular chamber, is a function of the outer diameter R1 and inner diameter R2 of the chamber and the height H of the liquid 5 in the chamber, that is:

$$T1 = f(R1, R2, H) \tag{2}$$

Thus, R1, R2 and H may be determined so that the natural frequency T1 is equal to the natural frequency To of the building 2.

According to Housner theory, the effective mass M2 of a free liquid which is movable in the tank 4, as mass of a vibrating body, is given by the following equation:

$$M2 = \frac{1}{4}\left(\frac{5}{6}\right)^2 \cdot \frac{27}{8} \cdot \frac{\tanh\sqrt{\frac{27}{8}}}{\sqrt{\frac{27}{8}} \cdot \frac{H}{R}} \cdot M \tag{3}$$

where H is the height from the bottom of the tank 4 to the level of the liquid 5, R is a radius of the tank, and M the mass of the liquid contained in the tank. (see "Dynamic Pressures on Accelerated Fluid Containers" by Housner, G. W., Bulletin of the Seismological Society of America, vol. 47(1957), pp. 15–35). The natural frequency of the liquid, i.e., natural frequency of sloshing, is given by the equation:

$$\omega^2 = \frac{H}{R} \cdot \sqrt{\frac{27}{8}} \cdot \tanh\left(\sqrt{\frac{27}{8}} \cdot \frac{H}{R}\right) \tag{4}$$

The natural period T1 of the liquid 5 in the tank 4 is thus obtained by the equation:

$$T1 = \frac{2\pi}{\omega} \tag{5}$$

Thus, the parameters H, R and M ar set so that the vibration period T1 of the liquid 5 in the tank 4 and the vibration period To of the building 2 have the following relation:

$$To = T1 \tag{6}$$

The ratio of the effective mass M2 of the liquid over the mass Mo of the building 2 is typically:

$$M2/Mo = 1/50 \sim 1/200 \tag{7}$$

Below the lower limit or about 1/200, vibration suppressing effect cannot be efficiently obtained while above the upper limit or about 1/50, the weight of the liquid will provide a considerable influence to the structural design of the building, thus making it necessary to amend the structural design. The lower limit is preferably about 1/100. However, the suppressing effect may be obtained even at about M2/Mo=about 1/300.

Figure 5:
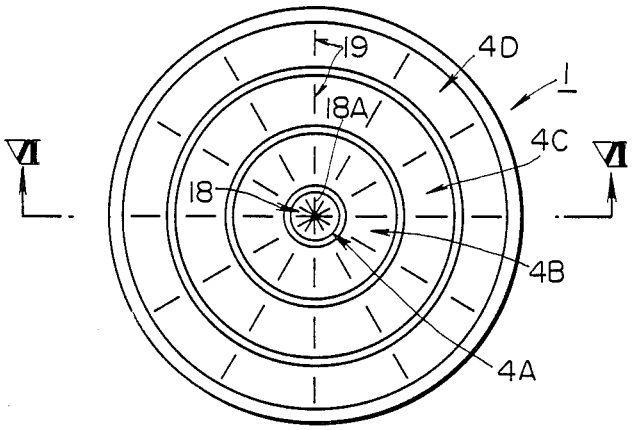
FIG. 5 is a plan view of a modified form of the vibration suppressing apparatus of FIG. 1.
Figure 6:
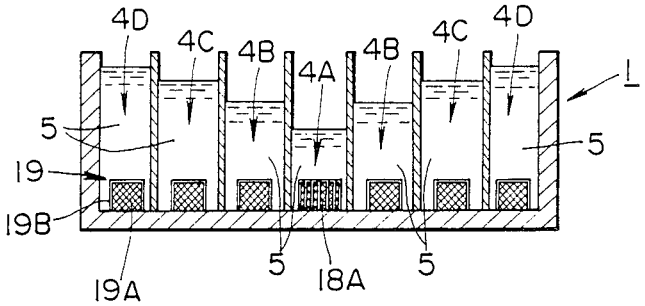
FIG. 6 is a view taken along the line VI—VI in FIG. 5.

A modified form of the vibration suppressing device 1 in FIGS. 1 to 3 is shown in FIGS. 5 and 6, in which like members are designated by the same reference characters and descriptions thereof are omitted after once given. In this modified vibration suppressing device, a multiplicity of screen members 18 and 19 are vertically mounted on the bottom of the tank 4 to axially extend for damping vibration of the liquid 5 in the tank. The screen member 18 has a star shape in plan view and is coaxially arranged in the tank 4A. The screen member 18 has twelve sub-screen members 18A arranged at regular angular intervals about the center of the outer tank 6. Each of the screen members 19 has a screen or a mesh 19A attached to a rectangular frame 19B to extend in it. Each mesh 19A may be made of a metallic wire or various kinds of conventional fibers. The sub-screen members 18A have a shape and structure similar to the screen members 19. Also the screen members 19 are arranged at regular angular intervals about the center of the outer tank 6. The number of the screen members 18 and 19 and the size of the screen thereof depend on the amount and physical nature of the liquid 5 in the outer tank 6. The screen members 18 and 19 are attached to the bottom 6B of the tank 4 with stoppers (not shown). Preferably, the stoppers are larger in number than the screen members 18 and 19 for change in number and size of the latter. A specific structure of the stoppers is disclosed in the previously-mentioned copending U.S. patent application Ser. No. 07/196,325 filed on May 20, 1988. The screen members 18 and 19 serve as an orifice of the conventional liquid damper for damping the vibration of the liquid by absorbing the kinetic energy of the liquid 5 when the latter passes through it. Thus, in the modified vibration suppressing device, the vibration thereof is diminished by dampening rapidly the vibration of the liquid 5, and hence it does not serve as an exciting source to the building 2.

The arrangement of the screen members 18 and 19 is not limited to the arrangement shown and described, but it depends on the shape and environment of the vibration suppressing apparatus 1. The screen members are not restricted in shape to those shown in FIGS. 5 and 6, either. A multiplicity of screens or corrugated screens may be horizontally stacked. Such alternative arrangements and shapes of the screen members 18 and 19 are proposed in the U.S. patent application Ser. No. 07/196,325. A fiber having a damping material, such as a nonwoven fabric, wound around another fiber or a metallic wire may be used for the screen 19A. The screen 19A may be formed by interweaving such fibers or stacking them in a lattice.

The screen members 18 and 19 are used for providing fluid resistance to the liquid 5, and hence, plate members, perforated plates, lattice members, floats floating in the liquid 5, rotating members, such as propeller, and sediment, such as sand, may be used in place of the screen members. Alternatively, ragged bottom of the outer tank 6 may be used for providing a similar effect as given by the screen members 18 and 19. The arrangement and shape of these damping mechanisms also depends on the shapes and construction conditions of the tank 4.

The vibration suppressing apparatus according to the present invention may be suitably used in other architectural or civil engineering constructions such as suspension bridges and towers.

While the invention has been disclosed in specific detail for purposes of clarity and complete disclosure, the appended claims are intended to include within their meaning all modifications and changes that come within the true scope of the invention.

What is claimed is:

1. An apparatus for suppressing vibration of a structure, the apparatus comprising:

a tank adapted to be mounted in the structure and having a bottom;

at least one annular partition wall concentrically arranged within said tank and erected on the bottom of said tank, said partition wall defining a plurality of annular chambers concentric about a vertical axis of said tank to receive a liquid for suppressing vibration of the structure, each of said chambers being adapted to contain such an amount of said liquid that said liquid in each chamber is equal in natural period to the structure, the total amount of said liquid in said tank being such that a ratio of effective mass of said liquid over mass of the structure is about 1/300 to about 1/50; and vibration damping means arranged in at least one of said chambers for damping vibration of said liquid contained in the at least one chamber, occasioned due to swinging of the structure, said vibration damping means comprising one or more screen members, each of said screen members comprising a mesh and being erected on the bottom of said tank and extending radially from said vertical axis relative to at least one said chamber, wherein said screen member allows said liquid to flow therethrough so as to baffle a circumferential flow of said liquid to said chamber due to the swinging of the structure.

2. The apparatus as recited in claim 1, wherein said mesh is formed of a material selected from the group consisting of a metallic wire and a conventional fiber.

3. The apparatus as recited in claim 1, wherein said vibration damping means comprises a plurality of the screen members, and wherein said screen members are arranged at angular intervals about said vertical axis of said tank.

4. The apparatus as recited in claim 3, wherein each of said screen members further comprises a frame mounted to the bottom of said tank, and wherein said mesh is attached to said frame to extend within said frame.

5. The apparatus as recited in claim 2, wherein each of said screen members further comprises a damping substance wound around said mesh-forming material.

6. The apparatus as recited in claim 5, wherein said damping substance comprises a nonwoven fabric.

7. The apparatus of claim 1, wherein said tank has an open central region, and wherein said apparatus further comprises a centrally located circular chamber formed in said central open region of said tank, said circular chamber being formed by said annular partition wall, and a screen member centrally disposed within said circular chamber, and allowing said liquid to flow therethrough to baffle the flow of said liquid in said open central region of said tank.

* * * * *